US006245162B1

(12) United States Patent
Baudis et al.

(10) Patent No.: US 6,245,162 B1
(45) Date of Patent: Jun. 12, 2001

(54) BORIDING AGENT

(75) Inventors: Ulrich Baudis, Alzenau; Stefan Wigger, Hanau, both of (DE)

(73) Assignee: Houghton Durferrit GmbH, Mannheim (DE)

( * ) Notice: Subject to any disclaimer, the term of this patent is extended or adjusted under 35 U.S.C. 154(b) by 0 days.

(21) Appl. No.: 09/349,722

(22) Filed: Jul. 8, 1999

(30) Foreign Application Priority Data

Jul. 9, 1998 (DE) ..... 198 30 654

(51) Int. Cl.[7] ..... C23C 8/06
(52) U.S. Cl. ..... 148/279; 148/283; 148/217
(58) Field of Search ..... 148/279, 280, 148/283, 217

(56) References Cited

U.S. PATENT DOCUMENTS 3,634,145 * 1/1972 Horman ..... 148/279
3,806,374 * 4/1974 Krzyminski ..... 148/279
3,809,583 * 5/1974 Krzyminski ..... 148/279
3,936,327 * 2/1976 Fichtl et al. ..... 148/279
4,126,488 * 11/1978 Kunst et al. ..... 148/279
4,637,837 * 1/1987 von Matuschka et al. ..... 148/279

OTHER PUBLICATIONS

Derwent English Language Abstract, SU 657941 A, Apr. 26, 1979.*

* cited by examiner

*Primary Examiner*—Roy King
*Assistant Examiner*—Andrew L. Oltmans
(74) *Attorney, Agent, or Firm*—Smith Gambrell & Russell, LLP

(57) ABSTRACT

A boriding agent for generating boride layers on metallic workpieces, containing boron-releasing substances, activating substances and, in the remainder, refractory, inert extender. The activating substance is a combination of 1 to 5 wt. % potassium tetrafluoroborate and 5 to 40 wt. % calcium fluoride, relative to the total quantity of the boriding agent. With this boriding agent it is possible for single-phase, $Fe_2B$-containing boride layers to be generated on workpieces made of ferrous materials. The agent results in lower emissions of fluorine and fluoride.

11 Claims, No Drawings

BORIDING AGENT

INTRODUCTION AND BACKGROUND

The present invention relates to a boriding agent for generating boride layers on metallic materials. The boriding agent of this invention serves, in particular, to generate single-phase, hard and firmly adherent boride layers on ferrous materials with a view to increasing the wear resistance and improving the corrosion resistance of the corresponding workpieces.

Boriding treatment with a view to imparting wearing protection to iron, steel and refractory metals is a process that has been known for a long time. As a result of diffusion of the element boron into the surface of the treated workpiece and reaction with the base material, impervious, uniform layers of the respective boride are formed on iron for example, the borides FeB, $Fe_2B$. In comparison with the pure metals, the borides possess considerably altered properties, in particular most borides are very hard, corrosion-resistant and hence extremely wear-resistant. By reason of the fact that they are generated as a result of diffusion and solid-state reaction, the boride layers are firmly connected to the base material. With regard to their wear resistance, for example, steels that have been subjected to boriding treatment are in some cases superior to the steels that have been treated by nitriding or carburizing.

A large number of agents and technical process variants have therefore been developed in the past with which boride layers, particularly on steel, can be produced.

In practice, boriding treatment using solid boriding agents is adopted almost exclusively. In this process the parts to be treated are packed in iron boxes into powder mixtures that consist substantially of boron-releasing substances, activating substances and, in the remainder, refractory, inert extenders. The closed boxes are annealed for some time, whereby the desired boride layers are formed on the particles in direct solid-state reaction or as a result of transport of the boron via the gas phase.

Boriding treatment is conventionally carried out at temperatures between 800 and 1,100° C. and in particular between 850 and 950° C. The achievable layer thicknesses of the boride layers lie in the range between 30 and 300 $\mu$m.

Amorphous and crystalline boron, ferroboron, boron carbide and borax come into consideration by way of boron-releasing substances as suitable boriding agents. Chloride-releasing or fluoride-releasing compounds such as alkali and alkaline-earth chlorides or fluorides are suitable by way of activating substances. Particularly customary in the art as activators are fluoroborates such as, in particular, potassium tetrafluoroborate. Typical extenders are aluminum oxide, silicon dioxide and silicon carbide. Boriding agents of this type are described in German patent 17 96 216, for example. A typical composition, which has proved its worth as a boriding agent up to the present day, contains approximately 5 wt. % boron carbide, 5 wt. % potassium tetrafluoroborate and 90 wt. % silicon carbide. Boriding agents of the stated type are normally used in the form of powder mixtures, but they may also be formulated as granulates (for example, German published application 21 27 096) or as pastes (for example, German published application 26 33 137). In the case of granulates and pastes the compositions additionally contain subordinate amounts of binding agents or water.

Furthermore, processes have also been developed that have operated with gaseous boriding agents such as diborane, boron halides or alternatively in molten salts with boron carbide and borax by way of boron-releasing substances. On account of the toxicity of the compounds and the disadvantages of the process such as the high monitoring effort for the purpose of obtaining an invariable boriding effect, these last-mentioned processes have been unable to gain acceptance. By reason of the influences of charging and of complex geometrical shapes, recent attempts to generate boride layers with plasma processes are not suitable for all applications. In addition, the effort in terms of apparatus is quite high. By reason of their advantages of simple applications and good boride layers, solid boriding agents that are also used, in part, in pasty form have therefore maintained their preeminent position even today for superficial boriding treatment.

However, the customary boriding processes with the known solid boriding agents have the disadvantage that it is very difficult, in terms of process engineering, to generate single-phase layers of iron boride with them, particularly on ferrous materials (see, for example, EP 0 387 536 B1).

Since the two borides $Fe_2B$ and FeB possess different properties and since multi-phase layers usually exhibit poorer properties than single-phase layers, the aim is to generate single-phase layers in the course of boriding treatment.

For instance, the FeB phase in particular, which is richer in boron, is substantially more brittle than the $Fe_2B$ phase, and this has a negative effect on the wear resistance of the components that have been subjected to boriding treatment. In the case of boride layers in excess of 50 $\mu$m, the formation of an outer layer of FeB, which is to be avoided as far as possible for the stated reason, can also occur very easily.

Moreover, in the case of the known boriding agents appreciable emissions of fluorine—on the one hand in the form of fluorine gas, on the other hand in the form of water-soluble fluoride—occur, by reason of the fluoride content of said boriding agents, in the course of washing the components or in the course of disposal of exhausted boriding agent.

It is therefore an object of the present invention to develop a boriding agent with which single-phase, $Fe_2B$-containing boride layers can be generated practically exclusively, in particular on ferrous materials. Moreover, the content of water-soluble fluorides in this boriding agent should be lowered and, given use as intended, there should be an associated reduced emission of fluorine.

SUMMARY OF THE INVENTION

The above and other objects of the present invention can be achieved by a boriding agent which consists essentially of boron-releasing substances, activating substances and, in the remainder, refractory, inert extender and which is characterized in that it contains, by way of activating substance, a combination of 1 to 5 wt. % potassium tetrafluoroborate and 5 to 40 wt. % calcium fluoride, relative to the total quantity of the boriding agent.

The invention provides a boriding agent characterized as in the foregoing for generating boride layers on metallic workpieces, in particular for generating single-phase, $Fe_2B$-containing boride layers on workpieces made of ferrous materials.

It has been shown that a conventional boriding agent, to which, besides conventional activator substances, calcium fluoride is added by way of further activating substance, results in a composition whereby selective influence and control can be effected with regard to the type of boride formation in the surface of the workpiece. In this connection it is possible, particularly in the case of workpieces made of ferrous materials, for single-phase $Fe_2B$ layers that are practically FeB-free to be generated readily without further elaborate measures in terms of process engineering.

DETAILED DESCRIPTION OF INVENTION

The boriding agent according to the invention accordingly contains by way of activating substance a combination of 1 to 5 wt. % potassium tetrafluoroborate ($KBF_4$) and 5 to 40 wt. % calcium fluoride ($CaF_2$), the quantitative data relating to the total quantity of the boriding agent. The boriding agent according to the invention preferably contains by way of activator substance a combination of 2 to 4 wt. %, in particular approximately 2.5 wt. %, potassium tetrafluoroborate and 10 to 30 wt. %, in particular approximately 25 wt. %, calcium fluoride.

In the case of a total replacement of $KBF_4$ by $CaF_2$ in the customary boriding agent according to the state of the art, investigations have shown that no adequate boride layers are formed on the workpiece surfaces under normal process conditions. The same result is obtained if, for the purpose of reducing the emission of fluorine, the content of $KBF_4$ in the boriding agent is merely decreased.

The conventional boron-releasing substances such as amorphous or crystalline ferroboron and, in particular, boron carbide ($B_4C$) may be contained in the boriding agent according to the invention. Said boriding agent preferably contains 2 to 10 wt. % boron carbide.

Moreover, the boriding agent according to the invention contains, in the remainder, the common extenders such as, in particular, silicon carbide (SiC).

The boriding agent according to the invention preferably contains by way of boron-releasing substance 2 to 10 wt. % boron carbide, by way of activating substance 1 to 5 wt. % potassium tetrafluoroborate and 5 to 40 wt. % calcium fluoride, and by way of extender in the remainder, silicon carbide.

A particularly preferred composition consists of 3 to 5 wt. % boron carbide, 2 to 4 wt. % potassium tetrafluoroborate, 10 to 30 wt. % calcium fluoride and 61 to 85 wt. % silicon carbide.

A typical composition consists of 4 wt. % $B_4C$, 2.5 wt. % $KBF_4$, 25 wt. $CaF_2$ and 68.5 wt % SiC.

The boriding agent according to the invention is typically employed in the form of a powder mixture. With a view to preparing a powder mixture of this type, the pulverulent initial substances are merely intimately blended, where necessary after being ground. The particle size of powder mixtures of this type typically lies in the range 10 to 250 $\mu$m. It can also be expedient to formulate the boriding agent according to the invention in the form of a granulate. For this purpose the corresponding powder mixture can, for example, be made into a paste with water and, optionally, a binding agent, and a granulate can be prepared from this in known manner. In the case of a granulate the particle size typically lies in the range from 0.1 to 2.5 $\mu$m. Moreover, for practical application it can be advantageous to formulate the boriding agent as a paste. The latter can be prepared from the corresponding powder mixture by, for instance, addition of water and, optionally, subordinate quantities of auxiliary substances such as binding agent, for example.

The boriding agent according to the invention can be used very advantageously for generating boride layers on metallic workpieces. By virtue of the fact that, in comparison with known compositions, the content of $KBF_4$ can be decreased by partial replacement with $CaF_2$, which is insoluble in water, the agent according to the invention is substantially less critical with regard to emissions of fluoride, relating in particular to the disposal of waste waters after washing of the components that have been subjected to boriding treatment and to the disposal of exhausted boriding agent. A reduced content of $KBF_4$ is, moreover, advantageous, given use of the agent as intended, since correspondingly lower emissions of fluorine gas occur.

A particular process advantage of the boriding agent according to the invention is that single-phase, $Fe_2B$-containing boron layers can be generated readily and without difficulty on workpieces made of ferrous materials.

In the process according to the invention for generating single-phase, $Fe_2B$-containing boride layers on workpieces made of ferrous materials the surface of the workpieces is covered with the boriding agent and said surface is then treated at temperatures between 800 and 1,100° C. until a boride layer having the desired thickness has formed. For this purpose the parts are packed in known manner in closed iron boxes into a powder mixture or into a granulate of the boriding agent according to the invention, so that the surfaces of the parts are totally covered. The surface of the parts can also be coated with a boriding-agent paste. This is advantageous when a surface is desired that has been partially subjected to boriding treatment.

The boriding treatment is preferably carried out at temperatures between 850 and 950° C. over a period of time from 20 minutes to 2 hours. In this process it is possible for single-phase $Fe_2B$ layers with a thickness from 30 to 150 $\mu$m. to be obtained.

EXAMPLE 1

(Comparative Example)

A component made of 42CrMo4 was subjected to boriding treatment for 30 min at 920° C. in a boriding agent according to the state of the art having the following composition:

4 wt. % $B_4C$
5 wt. % $KBF_4$
91 wt. % SiC.

The component could be taken out of the boriding agent reasonably easily; the boriding agent could only be triturated between the fingers with difficulty. The boride layer had a layer thickness of 45–50 $\mu$m, with FeB peaks being detectable to a depth of 16 $\mu$m. Emissions of fluorine gas amounting to about 4 g/kg boriding agent were measured.

EXAMPLE 2

(According to the Invention)

A component made of 42CrMo4 was subjected to boriding treatment for 30 min at 920° C. in a boriding agent according to the invention having the following composition:

4 wt. % $B_4C$
5 wt. % $KBF_4$
10 wt. % $CaF_2$
81 wt. % SiC.

The component could be taken out of the boriding agent reasonably easily; the boriding agent could be triturated between the fingers reasonably easily. The boride layer had a thickness of about 50 $\mu$m and was totally FeB-free. The layered structure was clearly more uniform than in the case of the layer from Example 1. Emissions of fluorine gas amounting to about 4 g/kg boriding agent were measured.

EXAMPLE 3

(According to the Invention)

A component made of 42CrMo4 was subjected to boriding treatment for 30 min at 920° C. in a boriding agent according to the invention having the following composition:

4 wt. % $B_4C$ 2 wt. % $KBF_4$ 30 wt. % $CaF_2$ 64 wt. % SiC.

The component could be taken out of the boriding agent easily; the boriding agent could be triturated between the fingers easily. The boride layer had a thickness of 50–55 μm, was totally FeB-free and had a very uniform, compact structure. The emissions of fluoride amounted to only 2 g/kg boriding agent.

EXAMPLE 4

(Comparative Example)

A component made of 42CrMo4 was subjected to boriding treatment for 30 min at 920° C. in a boriding agent having the following composition:

4 wt. % $B_4C$ 2 wt. % $KBF_4$ 94 wt. % SiC.

The component could be taken out of the boriding agent reasonably easily; the boriding agent could be triturated between the fingers quite easily. The boride layer had a thickness of 40–50 μm. A layer of FeB with layer thicknesses of up to 20 μm could be observed. Consequently no quality of layer satisfying the requirements is achieved in the case of a simple reduction of the $KBF_4$.

EXAMPLE 5

(Comparative Example)

A component made of 42CrMo4 was subjected to boriding treatment for 30 min at 920° C. in a mixture having the following composition:

10 wt. % $B_4C$ 30 wt. % $CaF_2$ 60 wt. % SiC.

The component could be taken out of the powder easily but exhibited only individual boride peaks of max. 16 μm; no closed boride layer was present. This proves that, although calcium fluoride brings about a low activation, it alone does not bring about an adequate activation.

Further modification and variations will be apparent of those skilled in the art from the foregoing and are intended to be encompassed by the claims appended hereto.

German priority application 198 30 654.7 is relied on and incorporated herein by reference.

We claim:

1. A boriding agent for generating a boride layer on a metallic workpiece, consisting essentially of at least one boron-releasing substance, an activating substance, and in the remainder, extender that is both refractory and inert, wherein said activating substance is a combination of 1 to 5 wt. % potassium tetrafluoroborate and 5 to 40 wt. % calcium fluoride, relative to the total quantity of the boriding agent.

2. The boriding agent according to claim 1, wherein said boron-releasing substance is 2 to 10 wt. % boron carbide.

3. The boriding agent according to claim 1, wherein said extender is silicon carbide.

4. The boriding agent according to claim 2, wherein said extendet is silicon carbide.

5. The boriding agent according to claim 1, wherein said boron-releasing substance is 2 to 10 wt. % boron carbide, said activating substance is 1 to 5 wt. % potassium tetrafluoroborate and 5 to 40 wt. % calcium fluoride, and said extender is silicon carbide.

6. The boriding agent according to claim 1, consisting essentially of 3 to 5 wt. % boron carbide, 2 to 4 wt. % potassium tetrafluoroborate, 10 to 30 wt. % calcium fluoride and 61 to 85 wt. % silicon carbide.

7. The boriding agent according to claim 1, consisting essentially of 4 wt. % boron carbide, 2.5 wt. % potassium tetrafluoroborate, 25 wt. % calcium fluoride and 68.5 wt. % silicon carbide.

8. The boriding agent according to claim 1, in the form of a powder, a granulate or a paste.

9. A process for generating single-phase, $Fe_2B$Containing boride layers on a workpiece made of a ferrous material, comprising covering the surface of the workpieces with a boriding agent according to claim 1 and heating the surface at temperatures from 800 to 1,100° C. until a boride layer having a desired thickness has formed.

10. The process according to claim 9, wherein the temperatures is from 850 to 950° C. and the heating is for a period of time from 20 minutes to 2 hours to thereby generate a layer of $Fe_2B$ having a thickness from 30 to 150 μm.

11. A workpiece made of a ferrous material having deposited on at least one surface of said workpiece a $Fe_2B$ layer produced by the process of claim 9.

* * * * *